United States Patent [19]

Stearman

[11] Patent Number: 4,551,181

[45] Date of Patent: Nov. 5, 1985

[54] CORROSION PREVENTION AND CLEANING OF AIR-COOLED HEAT EXCHANGERS

[75] Inventor: William L. Stearman, Jenks, Okla.

[73] Assignee: UOP Inc., Des Plaines, Ill.

[21] Appl. No.: 528,379

[22] Filed: Sep. 1, 1983

[51] Int. Cl.[4] ..... B08B 9/02

[52] U.S. Cl. ..... 134/22.11; 134/22.12; 165/95; 165/134.1; 208/47

[58] Field of Search ..... 208/47; 165/134 R, 95; 134/22.11, 22.12

[56] References Cited

U.S. PATENT DOCUMENTS

| | | | |
|---|---|---|---|
| 2,162,933 | 6/1939 | Bolinger et al. | 196/93 |
| 2,908,640 | 10/1959 | Dougherty | 208/351 |
| 2,911,351 | 11/1959 | Hill | 208/47 |
| 3,189,537 | 6/1965 | Carlton | 208/47 |
| 3,773,651 | 11/1973 | Stedman | 208/47 |
| 4,366,003 | 12/1982 | Korte et al. | 165/95 X |

*Primary Examiner*—Marc L. Caroff

*Attorney, Agent, or Firm*—Thomas K. McBride; William H. Page, II; Richard J. Cordovano

[57] ABSTRACT

Method for cleaning and retarding corrosion of air-cooled heat exchangers used in hydrocarbon processing operations. Treating liquid is discharged at a plurality of locations in the vapor distribution chamber at the inlets to the tubes of air-cooled exchangers. Treating liquid may comprise corrosion inhibitor-laden hydrocarbon or water.

4 Claims, 4 Drawing Figures

CORROSION PREVENTION AND CLEANING OF AIR-COOLED HEAT EXCHANGERS

BACKGROUND OF THE INVENTION

This invention relates to cleaning and retarding corrosion in heat exchange apparatus. More specifically, it relates to the distribution of liquids which retard corrosion of and remove deposits from tubular air-cooled heat exchangers used in hydrocarbon processing operations.

Prevention of corrosion in equipment used in hydrocarbon refining and processing is and has been the subject of much attention. A specific problem area is the overhead equipment and piping associated with distillation columns in certain processing units. Particular attention to process vapor condensing equipment is necessary. Carbon steels are predominantly used as materials of construction for such equipment. While it is possible to fabricate hydrocarbon processing equipment from metals which are less prone to corrosive attack, such as stainless steel and other high alloys, the cost of such equipment is sufficiently high that it is seldom used. Instead of higher metallurgy, prevention and protection measures are applied to carbon steel equipment. Particularly susceptible to excessive corrosion are the air-cooled heat exchangers used to cool and condense overhead vapors from the columns. Initial cooling of overhead vapors is often accomplished by heat exchange with feedstock or another hydrocarbon stream which requires heating. Further cooling and condensation is normally accomplished in a heat exchanger of the type in which liquid flows through a plurality of tubes over which atmospheric air is passed by means of a fan or fans. Fins are fitted to the exterior surface of the tubes to increase heat transfer area. This type is commonly referred to as air-cooled heat exchangers or fin-fan exchangers. Perhaps the most troublesome process in regard to corrosion is crude fractionation. Exemplary of other processing units of an oil refinery where fin-fan exchangers are subject to excessive corrosion are naphtha stabilizers, catalytic fractionators, catalytic gas plant depropanizers and debutanizers, and deisobutanizers.

The usual method of retarding corrosion in overhead equipment is to contact a corrosion-inhibiting substance with the affected metal surfaces. The corrosion inhibitor is mixed with hydrocarbons withdrawn from the processing unit and the mixture is returned to the unit, usually by injection into the overhead vapor line at a point close to the column. Since corrosion inhibitors are not inexpensive, it is desirable to use them only where the necessity of doing so is proven and then in the minimum quantities necessary for retardation of corrosion. There is often no question but that the use of corrosion inhibitors is necessary, such as in crude fractionation units. However, with many types of feedstocks and hydrocarbon processing units, it is virtually impossible to predict whether corrosion will be a problem. Thus, it is common to install the required equipment and commence use of inhibitors only after routine equipment inspections show that it is necessary. Though much progress has been made in the science of corrosion control in recent years, it is often necessary or expedient to proceed on the basis of initial experience in the processing unit at hand in light of experience in similar processing units. In many respects, the application of corrosion inhibitors may be considered more an art than a science.

In order to be effective, corrosion inhibitors must be brought into contact with the metal surfaces to be protected, so that a film of inhibitor may form over the surface. Inhibitors are generally relatively high boiling materials which are liquids at the conditions of pressure and temperature existing in the protected equipment. Upon introduction into an overhead vapor line, corrosion inhibitor-laden hydrocarbon droplets are spread through the vapor piping and equipment by the flowing stream of vapor. Experience has shown that the upper row or rows of tubes in fin-fan exchangers often are not sufficiently wetted with inhibitor-laden hydrocarbon. The vapor flow path to the upper tubes often contains enough convolutions that the inhibitor-laden droplets separate out and then are re-entrained to flow through the lower tubes but not the upper tubes. Those familiar with the design of liquid separators will readily appreciate the principles involved; put simply, one of the principles is that a liquid droplet often cannot flow along a path including an abrupt change of direction, as a result of its mass and momentum. Also, the mode of vapor distribution is often such that vapor velocities at the upper tubes are too low to keep liquid droplets entrained. The vapor velocity decreases as vapor enters the inlet vapor distribution chamber for the tubes. The velocity is often not high enough to lift inhibitor-laden droplets to the upper tube rows. When the upper tubes are not sufficiently wetted with inhibitor-laden hydrocarbon, the corrosion rate increases. Tube wall thickness is small in comparison with metal thicknesses in other equipment and in the inlet header boxes of fin-fan exchangers. A rate of corrosion acceptable elsewhere in a system may not be acceptable for exchanger tubes. Thus the tubes are particular problem areas. In order to protect the tubes, it is often necessary to add corrosion inhibitor in larger quantities than necessary to protect all of the other surfaces; that is, to attain minimum sufficient protection of exchanger tubes requires an excess for all other surfaces.

Another common problem, which is closely related to the above discussion, is the deposition of ammonium salts, particularly ammonium chloride, on fin-fan exchanger tubes. Such deposition may be referred to as desublimation or reverse sublimation. Compounds present in the hydrocarbon vapor solidify to form salt deposits without passing through a visible liquid state. The salts promote corrosion of the surfaces on which they are deposited. It is common practice to introduce liquid water into the overhead vapor line for the purpose of dissolving and washing away salts as they form on equipment surfaces. Upper tubes of fin-fan exchangers are particularly susceptible to salt accumulation and corrosion resulting therefrom for the same reasons that they are particularly susceptible to corrosion as discussed above; that is, water droplets do not reach the upper tubes. A further problem caused by salt deposits is loss of heat exchange capacity as a result of their impeding the flow of vapor through the upper tubes.

Further background information may be obtained by consulting the U.S. patents mentioned under the heading "Information Disclosure" contained herein. U.S. patents which are exemplary of those disclosing substances used as corrosion inhibitors are U.S. Pat. No. 3,676,327 (Foroulis); U.S. Pat. No. 3,583,901 (Piehl); U.S. Pat. No. 3,537,974 (Foroulis); U.S. Pat. No. 3,516,922 (Anzilotti); U.S. Pat. No. 3,247,094 (Dajani);

U.S. Pat. No. 2,920,080 (Thompson); U.S. Pat. No. 2,586,323 (Glassmire and Smith); and U.S. Pat. No. 2,415,161 (Camp).

INFORMATION DISCLOSURE

U.S. Pat. No. 2,911,351 (Hill) deals with protecting the shell side of a shell and tube heat exchanger from corrosive attack by sulfur bodies by means of continuously introducing a rain of corrosion inhibitor in the upper shell portion. U.S. Pat. No. 2,162,933 (Bolinger et al) discloses a method of protecting condenser tubes and the like from corrosion or salt deposition comprising injection of liquid water. Injection of hydrocarbon liquids, to which a corrosion inhibitor has been added, into vaporized hydrocarbons flowing to a condenser is discussed in U.S. Pat. No. 2,908,640 (Dougherty). U.S. Pat. No. 3,189,537 (Carlton) discloses methods of retarding corrosion in a heat exchanger used to cool hot hydrocarbon vapors from a crude column. The addition of water for corrosion control for short periods of time is disclosed in U.S. Pat. No. 3,773,651 (Stedman).

BRIEF SUMMARY OF THE INVENTION

It is an object of this invention to provide a method and apparatus for retarding corrosion of tubular air-cooled heat exchangers, also called fin-fan exchangers, which are used in cooling hydrocarbon vapors in hydrocarbon processing plants.

It is also an object of this invention to provide a method and apparatus for cleaning, or removing salt deposits from said exchangers.

It is a further object of this invention to provide a method and apparatus effective in reducing the quantity of corrosion inhibitor which must be added to a system.

Another object of this invention is to provide apparatus which can be easily retrofitted in existing fin-fan units.

Other objects will become apparent upon consideration of the whole specification.

In the practice of the invention, treating liquid is discharged at a plurality of locations in the inlet vapor distribution chamber of an exchanger. The treating liquid used in retarding corrosion is water or a hydrocarbon laden with a corrosion inhibitor. Corrosion inhibitor protects metal surfaces which it contacts from corrosion while water dissolves and washes away salt deposits which promote corrosion of surfaces in which they are in contact. Separate from its corrosion-retarding function, water also cleans said exchangers by removing deposits which have formed. When water is used only for cleaning, it may be discharged intermittently.

Treating liquid may be discharged in the upper portion of an inlet header box at points spaced along the length of the header box. The discharge points may be located no lower than the lowest row of tubes which are to be cleaned or protected from corrosion by the method and apparatus of the invention, since the problems addressed by the invention do not normally occur in regard to the lower rows of tubes. However, the invention is not so limited, but may be practiced in regard to all tubes, if necessary to accomplish its objectives. One spray conduit or more than one spray conduit having a plurality of discharge nozzles may be used. The discharge nozzles may be arranged and located such that a stream of liquid from at least one discharge point flows toward each tube for which this invention is to be utilized. At least a portion of the discharge nozzles may be located in that part of the spray conduit which can be described as generally facing toward the tubes or such that treating liquid is directed upward as it leaves the discharge nozzles.

DETAILED DESCRIPTION OF THE INVENTION

As stated above, the invention is useful in many types of processing units in hydrocarbon processing plants. An example is now presented in which a processing unit for the fractionation of crude oil and the practice of the invention therein is described. The use of this example is not meant to limit the scope of the invention, but is presented to aid in understanding it.

Figure 1:
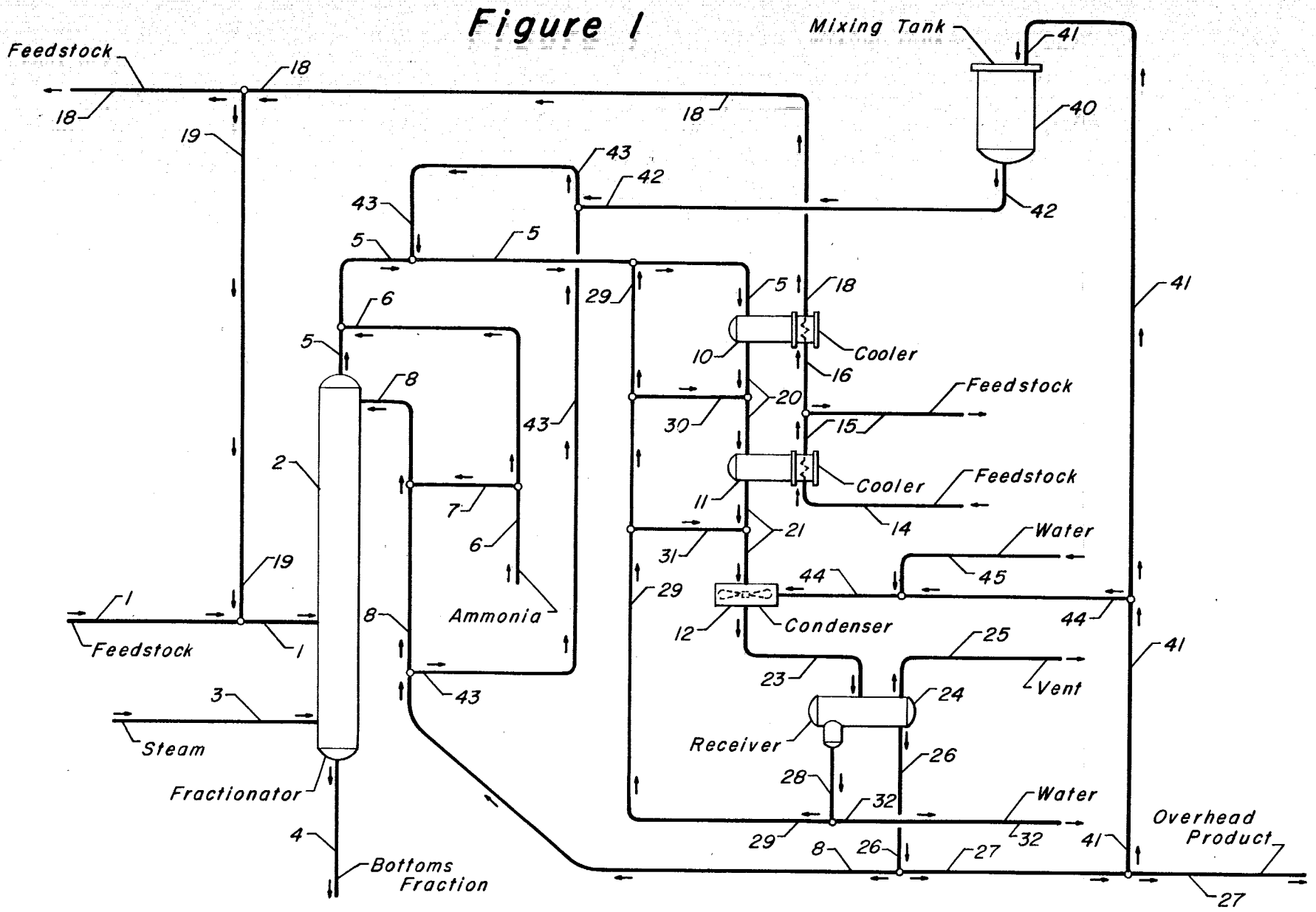
FIG. 1 depicts a crude fractionation unit, which is one of the types of processing units in hydrocarbon processing plants in which the invention is useful. Pumps, valves, instruments, and other components necessary to the operation of the unit are not shown, such equipment not being necessary to an understanding of the invention and within the knowledge of those familiar with such units.

Referring to FIG. 1, crude oil is introduced through line 1 to fractionator 2. In fractionator 2, the crude oil is separated into an overhead fraction, generally comprising gasoline boiling components and containing vaporized acidic components and a bottoms fraction. To facilitate separation in fractionator 2, steam is introduced thereto through line 3 and this serves to effect steam stripping and improved separation. In the case here illustrated, the heavier components of the crude oil are withdrawn from fractionator 2 through line 4 for any further treatment as desired. Generally, fractionator 2 also will contain side cut strippers in order to separate kerosene and one or more middle distillate fractions, but these have been omitted from the drawing.

The vaporized fraction is removed from the upper portion of fractionator 2 through line 5 and is cooled and condensed to separate liquid hydrocarbon from water and gases. As illustrated in the drawing, ammonia is introduced through line 6 and all or a portion of the ammonia is injected into line 5 or all or a portion is introduced into the upper portion of fractionator 2 by way of lines 7 and 8. Line 8 is used to return liquid reflux to the upper portion of the fractionator to serve as a cooling and refluxing medium therein as will be hereinafter described. The ammonia is introduced in a concentration to maintain the vaporized effluent at a pH within the range of from about 4.5 and preferably from about 6.5 to about 7.5 and, accordingly, will vary with the specific vaporized hydrocarbon fraction being cooled and condensed. In most cases, the amount of ammonia will be from about 1 to about 100 parts per million based on the overhead vapor. However, in some instances, the charge being fractionated may contain ammonia or other nitrogenous components in a comparatively large concentration and the injection of extraneous ammonia is not required or the amount of extraneous ammonia may be reduced.

The vaporized overhead fraction from fractionator 2 is passed through line 5 into and through heat exchangers. The exact number of heat exchangers will depend upon the particular system employed. In the case here illustrated, the cooling and condensing system includes coolers 10 and 11 and condenser 12. In the condenser, a fin-fan exchanger, the hydrocarbon fraction is cooled by indirect heat exchange with atmospheric air. In the system illustrated in FIG. 1, the feedstock to fractionator 2 is first partially preheated by being passed through line 14 into and through cooler 11 and then directed by way of line 15 and, while all or a portion may be removed through an extension of this line, at least a portion of the charge is passed by way of line 16 into and through cooler 10. The preheated charge is withdrawn from heat exchanger 10 through line 18 and, while all or a portion may be removed from the process through the extension of this line, at least a portion thereof is directed by way of line 19 into line 1 for subsequent introduction into fractionator 2. Generally, additional heating of the charge is provided and this may be accomplished in any suitable manner, not illustrated, including additional heat exchangers and/or a fired heater.

The hydrocarbon vapors pass by way of line 5 into and through cooler 10, through line 20, into and through cooler 11, through line 21, into and through condenser 12, and then by way of line 23 into receiver 24. In receiver 24, normally gaseous material is vented by way of line 25. Liquid hydrocarbons are withdrawn from receiver 24 through line 26 and all or a portion thereof are removed from the process by way of line 27. Preferably, at least a portion of the condensed hydrocarbon liquid is recycled by way of line 8 to the upper portion of fractionator 2 to serve as a cooling and refluxing medium therein.

Water is separated in receiver 24 and is removed therefrom by way of line 28. It is removed from the processing unit by means of line 32. A portion of the water may be recycled by way of line 29 to commingle with the hot hydrocarbon fraction passing through line 5. Depending upon the temperature and the composition of the hot hydrocarbon vapors, the reused water may be introduced into line 5, into line 20 by way of line 30 or into line 21 by way of line 31. In some cases, a portion of the water may be introduced at one or more points indicated above.

In accordance with common procedure, a corrosion inhibitor is added to mixing tank 40 by means not shown in the drawing. A quantity of hydrocarbon is removed from line 27 and transferred to mixing tank 40 through line 41. After mixing is accomplished, a mixture of corrosion inhibitor and hydrocarbon is withdrawn from tank 40 through line 42 for injection into the overhead vapor line. In order to provide an appropriate dilute mixture of corrosion inhibitor and hydrocarbon, a sidestream in line 43 is withdrawn from the reflux in line 8. The mixture in line 42 is combined with the sidestream of line 43 at a point such that there will be adequate mixing of the stream before line 43 discharges into line 5.

In order to practice the invention in one of its embodiments, line 44 is provided to carry corrosion inhibitor-laden hydrocarbon from line 27 by way of line 41 to condenser 12. The material flowing in line 27 contains a portion of the corrosion inhibitor which is added to line 5. As can be seen from FIG. 1, corrosion inhibitor-laden hydrocarbon for practice of the invention can be obtained from other locations in the crude fractionation unit. For example, it could be taken from line 42 or line 43 if it was desired to add hydrocarbon containing a larger concentration of inhibitor. Line 45 is connected to a convenient source of supply for water (not shown) such as line 32. The water is provided to condenser 12 for practice of an embodiment of the invention.

Figure 2:
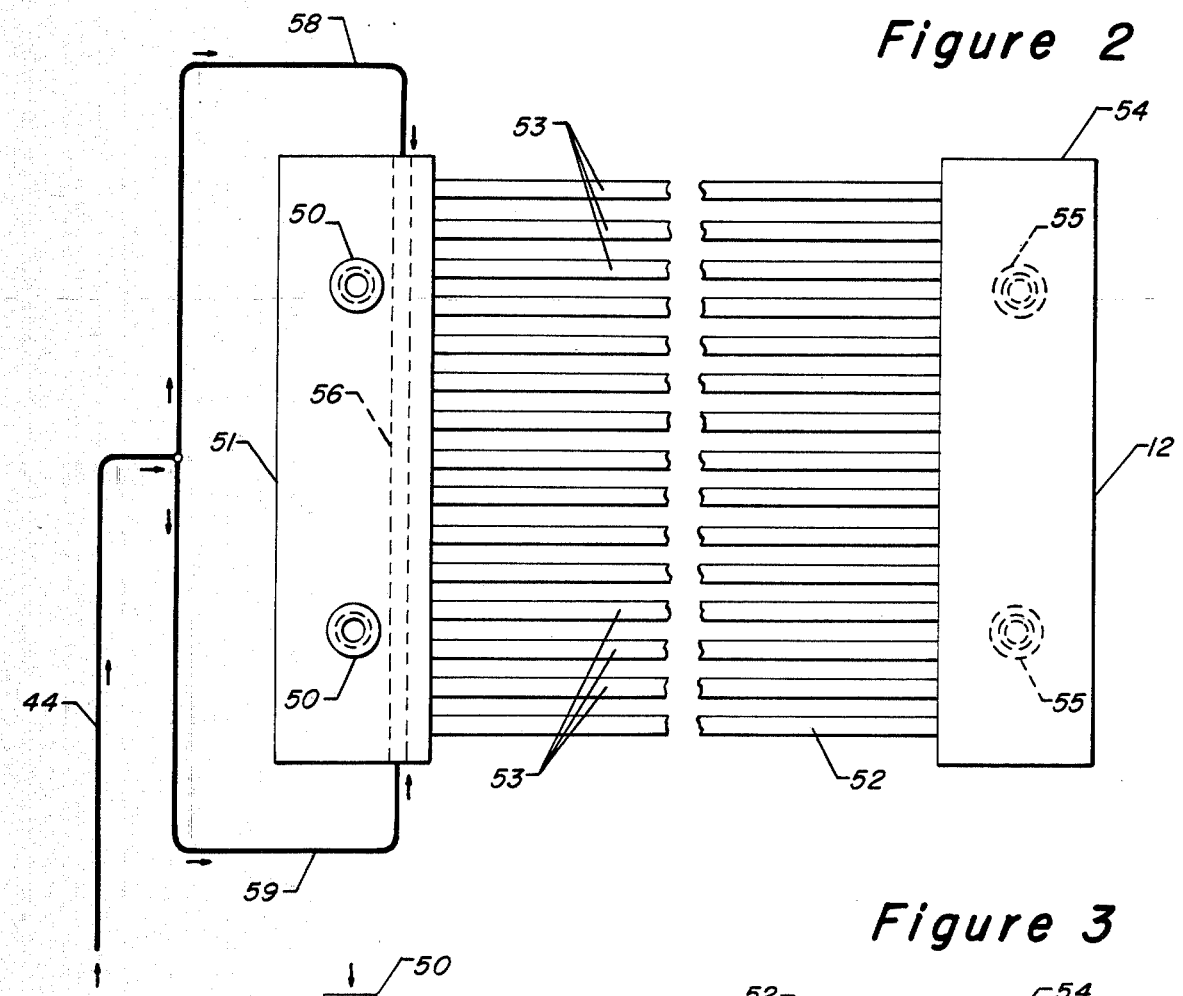
FIG. 2 is a schematic representation of an air-cooled heat exchanger, viewed from the top, with a depiction of one embodiment of the invention added thereto. The fin-fan exchanger is depicted with a relatively small number of tubes for convenience of drawing.
Figure 3:
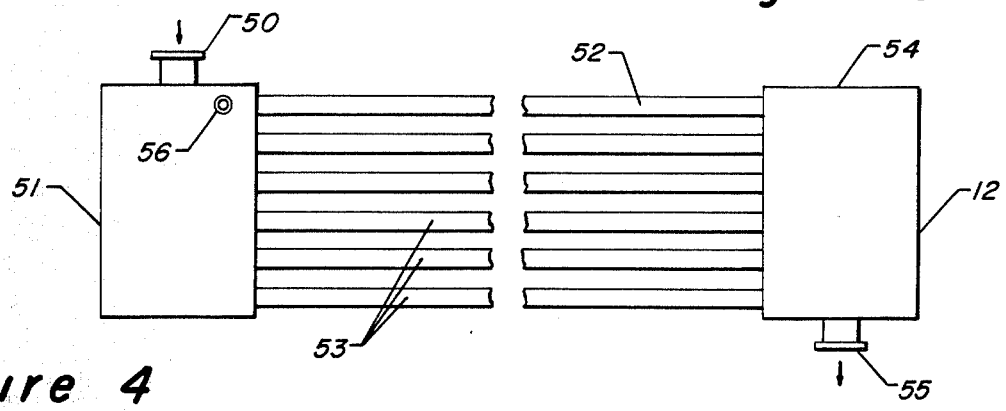
FIG. 3 is a schematic representation of the air-cooled heat exchanger of FIG. 1, viewed from the side, with the exterior piping omitted.

Referring to FIGS. 2 and 3, hydrocarbon vapor enters the fin-fan exchanger from line 21 of FIG. 1 at inlet nozzles 50. There are usually multiple inlet nozzles spaced along inlet header box 51, which is a vapor distribution chamber at the inlet of the tubes. The vapor fills inlet header box 51 and flows into a plurality of tubes denoted by reference numbers 52 and 53. All of the tubes terminate in outlet header box 54. Condensation of hydrocarbon vapor takes place in the tubes and the resulting liquid collects in outlet header box 54. Liquid and uncondensed vapor and gas is removed through piping (not shown) connected to outlet nozzles 55 which is denoted as line 23 in FIG. 1. Fans which blow atmospheric air over the tubes are not shown. The tubes are usually of the type having external fins to increase the transfer of heat from the material inside to the air. The tubes are almost always in a horizontal plane.

Still referring to the example of FIGS. 2 and 3, a liquid distributor in the form of horizontal spray conduit 56 is provided inside inlet header box 51. Water or corrosion inhibitor-laden hydrocarbon is provided to the exchanger through line 44 as shown in FIG. 1. In order to improve the distribution of liquid, lines 58 and 59 feed the two ends of spray conduit 56 and are arranged in a symmetrical manner. However, spray conduit 56 may be provided liquid at only one end. Conduit 56 is provided with a multiplicity of discharge nozzles (not shown) to distribute liquid to the tubes. Conduit 56 is positioned so that the invention can be practiced in regard to the uppermost row of tubes and the several rows beneath the uppermost row. The uppermost row of tubes consists of those tubes which are in a horizontal plane and behind tube 52 in FIG. 3.

Figure 4:
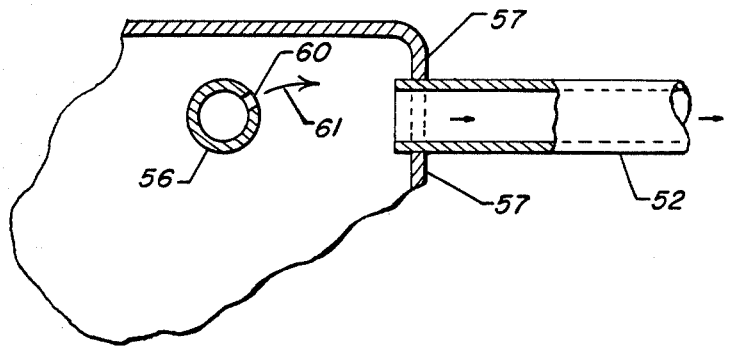
FIG. 4 is a schematic representation of a section taken through a portion of FIG. 3, depicting the conduit of the invention and a portion of a tube.

Now referring to FIG. 4, cross-sections of spray conduit 56 and tube 52 are depicted. Reference number 57 denotes a portion of the wall of inlet header box 51. Discharge nozzle 60 is depicted as a hole in conduit 56. Arrow 61 is shown to indicate liquid discharging from nozzle 60 toward the end of tube 52. This liquid will be carried into tube 52 by the flowing vapor. Thus, corrosion inhibitor-laden hydrocarbon or water is distributed to accomplish the objectives of the invention. Looking at FIG. 3, one can visualize that liquid droplets entering inlet header box 51 via inlet 50 must make a sharp turn in order to enter tube 52 and other tubes in the upper rows. As referred to above, this abrupt change of direction may cause droplets of inhibitor to be disentrained from the vapor, so that sufficient inhibitor from the entering vapor does not reach the upper tubes. It is preferred that the spray conduit be located no lower than the lowest row of tubes which require cleaning or protection from corrosion. It is desirable that treating liquid be discharged in such a location that it is not necessary to depend on vapor entrainment to move droplets upward. It can be seen that one or more additional spray conduits containing a plurality of discharge nozzles can be installed in header box 51 if necessary to provide liquid in direct proximity to additional rows of tubes or to provide more liquid.

The discharge nozzles used in the practice of this invention may consist simply of holes drilled in the conduit, slots in the conduit, or may be apparatus designed for the purpose, commonly called spray nozzles. The selection and sizing of discharge nozzles is a familiar procedure to those knowledgeable in fluid flow. There must be a sufficient pressure in the conduit to force the liquid through the nozzles and the conduit pressure must be approximately the same at all points so that approximately equal amounts of liquid will flow through each discharge nozzle. Alternatively, hole size or hole density may be varied. To calculate an effective pressure and determine nozzle and conduit sizes given the flow of liquid, reference may be made to Technical Paper No. 410, published by the Crane Co. of Chicago and New York. The required flow of liquid depends on a variety of factors, most important of which are the number of tubes to be cleaned or protected and the quantity of liquid which reaches the upper tubes independent of the practice of the invention. One skilled in the art can easily establish a trial flow rate, which would be reviewed after accumulation of operating experience; however, this initial rate would seldom exceed 0.1 gpm/tube when inhibitor-laden hydrocarbon is supplied and twice that when water is supplied.

Positioning of discharge nozzles in the spray conduit is based on a variety of factors apparent to those skilled in the art. For example, with relatively high vapor velocity in the inlet header box, nozzle positions are irrelevant as long as they are spaced along the length of the conduit. In most cases, though, it is desirable to locate at least a portion of the nozzles in that portion of the conduit which is generally "facing" the tubes, that is, in that half of the conduit which is toward the direction of vapor flow. It is also desirable to place at least a portion of the discharge nozzles in such a manner that the treating liquid is directed upward. Often, at least a portion of the nozzles are placed in the upper quadrant of the conduit as is done in the case of discharge nozzle 60 of FIG. 4, which is at an angle of 45° to the horizontal. It can be seen that liquid will contact the wall 57 around the tube. If it is desired to direct a substantial amount of liquid directly into a tube, such as in a situation where salt deposits some distance down the tube are to be washed away with water, a nozzle can be positioned so that a jet of liquid spurts into each tube with a minimum of splashing on other surfaces. It is often possible to practice the embodiment of the invention using water addition on an intermittent basis. For example, water could be added for one hour each day or five minutes each hour or only whenever deposits have formed.

As mentioned above, it is common to commence use of corrosion inhibitors only after equipment inspections show that it is necessary to do so. Even in a crude fractionation unit, equipment for the practice of the present invention would probably not be installed until operating experience indicated the necessity. The equipment needed to practice the invention is easily retrofitted, as can be appreciated from the drawings. Existing inspection openings in the inlet header box may be used for installation of conduit 56 and/or additional openings may be made. The line for providing corrosion inhibitor-laden hydrocarbon or water to the fin-fan exchanger, such as line 44, may have additional equipment installed in it. A filter or screen may be provided to remove debris which might plug the liquid distribution nozzles in the header box. A check valve may be provided to prevent loss of hydrocarbon to the atmosphere in case of line separation. Apparatus for flow control may be provided; an orifice plate will be satisfactory in most cases but more sophisticated apparatus can be used. Treating liquid can usually be taken from the discharge of an existing pump, but if desired, a separate pump may be provided to deliver treating liquid to the spray conduit at the proper pressure. It is not necessary to discuss herein the concentrations of corrosion inhibitor in hydrocarbon and the particular inhibitors which might be used, as this information is well known to those skilled in the art, this becoming apparent from the U.S. patents mentioned herein.

I claim as my invention:

1. A method of retarding corrosion in a fin-fan heat exchanger used in cooling vapors comprising hydrocarbons, said exchanger being comprised of a tube-side inlet vapor distribution chamber having at least one inlet nozzle, an outlet header box having at least one outlet nozzle, a plurality of heat exchange tubes having inlet ends in communication with said inlet vapor distribution chamber and having outlet ends in communication with the outlet header box, where said tubes are arranged in a plurality of horizontal rows, each row being located on one of a series of horizontal planes parallel to one another, said exchanger being further comprised of at least one spray conduit for practice of said method having a plurality of treating liquid discharge nozzles, which spray conduit is located perpendicular to said tubes and on a plane parallel to said series of horizontal planes, said method comprising discharging treating liquid from said treating discharge nozzles at a plurality of discharge points inside the inlet vapor distribution chamber, wherein said treating liquid becomes dispersed in droplets in said vapors comprising hydrocarbons which are flowing toward said tube inlet ends, where said discharge points are located no lower than the lowest row of tubes to be treated by said method and are further located adjacent to said tube inlet ends such that paths of vapor flow between said discharge points and said tube inlet ends do not include an abrupt change of direction, thereby permitting said droplets to flow into said tube inlet ends.

2. The method of claim 1 further characterized in that said treating liquid is water.

3. The method of claim 1 further characterized in that said treating liquid is a corrosion inhibitor-laden hydrocarbon.

4. The method of claim 1 further characterized in that at least a portion of said discharge points are located in such a manner that treating liquid from at least one discharge point flows toward each tube to be treated by said method.

* * * * *